US006940007B2

(12) United States Patent
Schmidt

(10) Patent No.: US 6,940,007 B2
(45) Date of Patent: Sep. 6, 2005

(54) PAD WITH IMPROVED SOUND-REFLECTING SURFACE FOR WOODWIND MUSICAL INSTRUMENTS AND LUBRICANT TO PREVENT PADS FROM STICKING

(75) Inventor: James E. Schmidt, Sanger, CA (US)

(73) Assignee: James Schmidt, Sanger, CA (US)

( * ) Notice: Subject to any disclaimer, the term of this patent is extended or adjusted under 35 U.S.C. 154(b) by 175 days.

(21) Appl. No.: 10/353,588

(22) Filed: Jan. 30, 2003

(65) Prior Publication Data

US 2003/0154845 A1 Aug. 21, 2003

Related U.S. Application Data

(60) Provisional application No. 60/358,171, filed on Feb. 20, 2002.

(51) Int. Cl.[7] ..... G10D 7/08
(52) U.S. Cl. ..... 84/385 P
(58) Field of Search ..... 84/385 P

(56) References Cited

U.S. PATENT DOCUMENTS 3,767,506 A * 10/1973 Kawakami ..... 156/293
3,776,090 A * 12/1973 Ihara ..... 84/380 R
4,190,746 A * 2/1980 Harwood et al. ..... 381/427
4,552,243 A * 11/1985 Melillo et al. ..... 181/169
5,406,038 A * 4/1995 Reiff et al. ..... 181/167

FOREIGN PATENT DOCUMENTS

WO WO 90/05973 * 5/1990

* cited by examiner

*Primary Examiner*—Shih-Yung Hsieh

(57) ABSTRACT

A pad for musical wind instruments with improved acoustic qualities. The acoustical improvement is achieved by providing a superior sound reflecting surface on the film or skin of the pad that engages with the tonehole.

A lubricant for the sealing surface of the pad to prevent the pad from sticking to the tonehole rim.

An outer retaining ring used to fasten the film to the pad while an inner collar supports the film and helps to create a smooth pad with a flat surface.

17 Claims, 7 Drawing Sheets

PAD WITH IMPROVED SOUND-REFLECTING SURFACE FOR WOODWIND MUSICAL INSTRUMENTS AND LUBRICANT TO PREVENT PADS FROM STICKING

This application claims the benefit of Provisional Patent Application Ser. No. 60/358,171 filed Feb. 20, 2002

STATEMENT REGARDING FEDERALLY SPONSORED RESEARCH OF DEVELOPMENT

Not Applicable

REFERENCE TO MICROFICHE APPENDIX

Not Applicable

BACKGROUND OF THE INVENTION

Conventional pads tend to absorb and muffle the tone of wind instruments. The present invention offers improvements over conventional pads because it uses a surface that is more sound reflective than the surface used by conventional pads. Conventional flute pads use gut skin and conventional sax pads use leather. These materials are not ideal for sound production. It has been found that harder pads are more sound reflective. This applies to the thickness/hardness of the cushion as well as to the sealing surface that engages with the tonehole. Unfortunately it is not possible to make a hard closing surface without making the key closing noise unduly loud, so compromises are made. Pliant films with hard skins have not been available to use in the wind instrument industry. It is for that reason that the wind instrument industry has been using the same basic materials for many years. In order to make a new pad attractive to the industry, it must provide good (preferably improved) tone. It is also beneficial if the new pad is visually attractive.

Conventional pads have a skin that is wrapped and glued to the back side. An improved design would use an alternative method of securing the skin to the pad cushion while creating a smooth flat surface on the pad surface that engages with the tonehole of a musical wind instrument.

Conventional pads experience a common problem of stickiness because the pad sealing surface can adhere temporarily to the corresponding tonehole. The present invention is provided with a lubricant that prevents this sticking problem.

BRIEF SUMMARY OF THE INVENTION

The present invention incorporates a hard material such as metal film, plating, or particle impregnation on and/or within the sealing surface of the pad. Altering the surface of the sealing surface in this manner improves the tone and offers a new and attractive appearance.

A dry lubricant can be applied to the sealing surface to prevent the stickiness that commonly plagues conventional pads.

An outer retaining ring used to fasten the film to the pad while an inner collar supports the film and helps to create a smooth pad with a flat surface.

DETAILED DESCRIPTION OF THE PRESENT INVENTION

Figure 1:
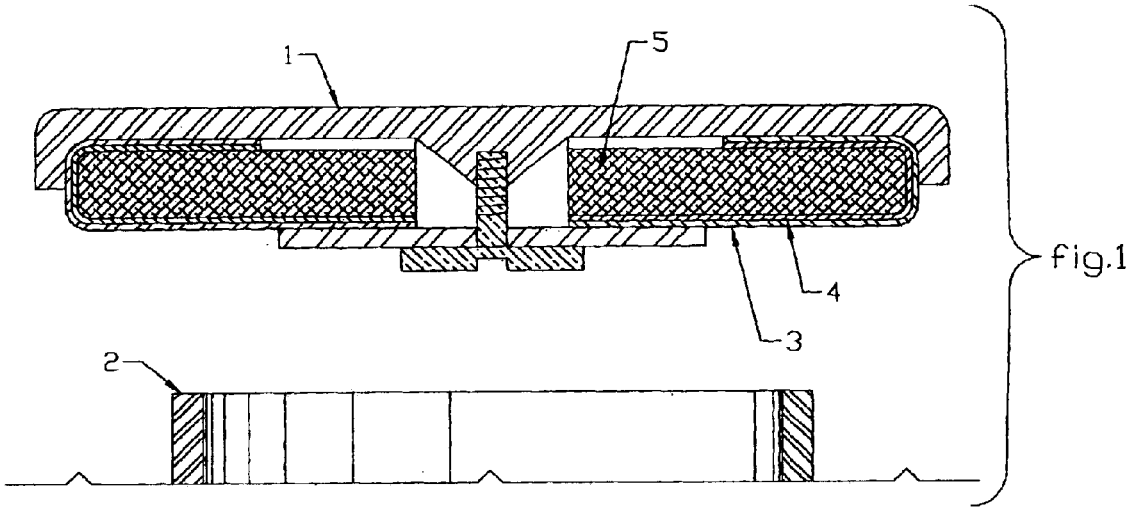
FIG. 1 is a cross sectional view of a pad and musical instrument tonehole showing a cup, cushion, substrate film and sealing surface.
Figure 2:
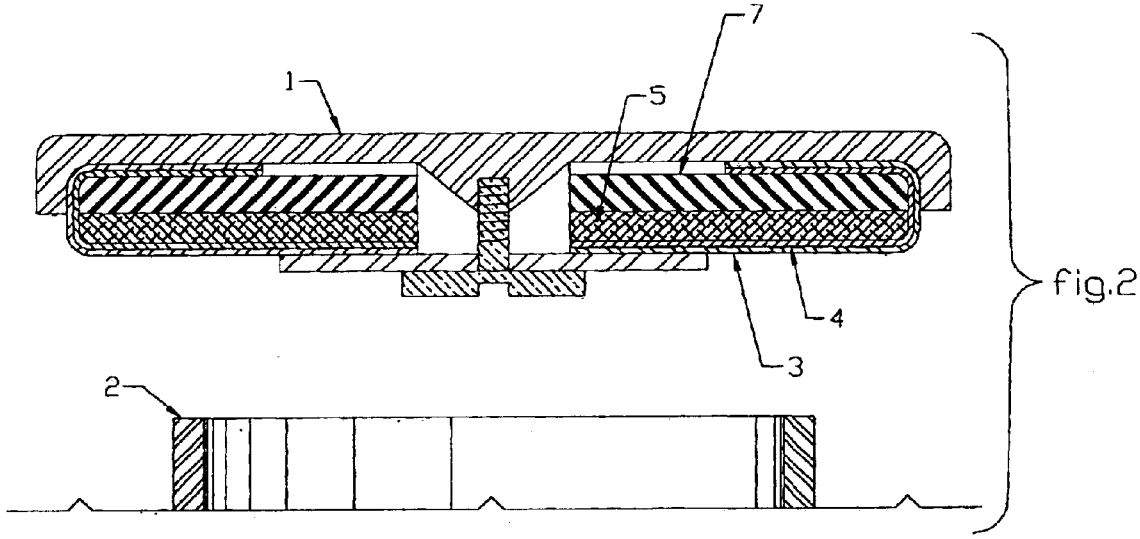
FIG. 2 is similar to FIG. 1 and shows an alternate version of the invention where a cushion is supported with a backing plate.
Figure 3:
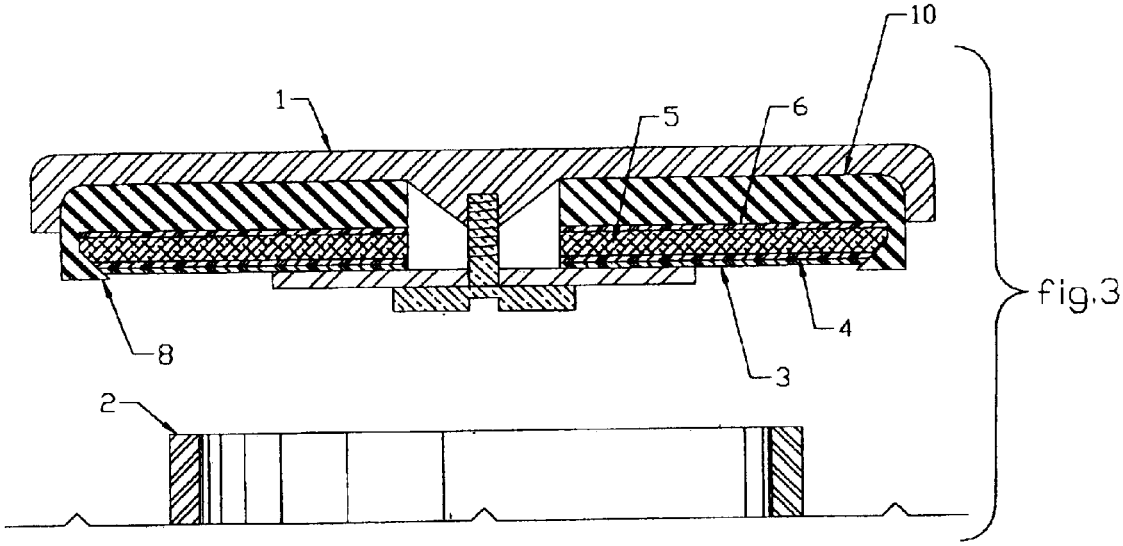
FIG. 3 is similar to FIG. 2 and shows a sealing surface that is held in place by an outer retaining lip.

In order to improve the tone of musical instruments it has been found that a hard pad surface will reflect sound better than a soft (sound absorbing) surface. FIGS. 1–3 show a hard material 3 on or near a pad sealing surface 3 that engages with a tonehole 2. A very hard and thick material (such as solid plastic or metal) would not be acceptable because it would create excessive noise when a pad engages with a tonehole. However, it has been found that a very thin layer of metal or other hard material can be applied to an underlying flexible film or substrate 4 such as gut skin, or film with a polymeric structure in order to provide a sound reflecting surface that is hard yet pliable enough to conform to any irregularities or unevenness presented when a pad engages with a tonehole 2.

A hard layer of material 3 may be a metallic film or powder that is plated or layered on top of a pad sealing surface film 3. The method in which a metallic material is applied may be vacuum deposition, coating, magnetron sputtering, spray, magnetic material deposition, electroplating, electrolysis plating, metalized by evaporation deposition, or other method. A thin metallic layer may simply be glued on to a substrate of film. The glue can be painted or sprayed onto the sealing surface film so that a metal foil or other hard layer will adhere to a sealing surface. Film adhesives that are applied as a sheet provide an alternate method of bonding the metal or other hard layer to the substrate film. The metallic foil (or other hardening material) can also be impregnated into film that underlies the sealing surface. Heat may used when bonding a metal to a film. Whatever method or material is used, the composite film must remain compliant and flexible so that it conforms to irregularities of the tonehole rim 2 and allows the cushion 5 beneath the film to soften the noise of a pad when it impacts against a corresponding tonehole 2.

The present invention uses bonding and impregnating techniques that have not been previously available to craftsmen practiced in the art of musical instrument making. It has previously been thought impossible to plate flexible films with a hard material (metal or otherwise) that will withstand the environment within musical wind instruments. Commonly manufactured metalized Mylar, Nylon and similar films will shed a metal coating when exposed to moisture.

This makes them unsatisfactory because of the moisture caused by breath condensation while playing a wind instrument. Protecting the metal or other hard material at the pad sealing surface by laminating another protecting but non-hard layer over the top of it defeats the purpose because it covers up the hard material and exposes yet another soft layer to the air column and tonehole rim of a musical instrument. The present invention incorporates new bonding and impregnation developments that make it possible to satisfactorily attach hard materials to flexible films.

The hardening material may be of a different material than metal such as powdered ceramic, powdered crystals, hard plastic granules, carbon fiber filaments, glass filaments such as fiberglass, natural fibers or any hardening material that is applied to the surface and/or impregnated into the sealing surface film.

A substrate sealing surface film 4 can be any thin material such as Nylon, Mylar, PET or other film with a polymeric structure. Or it can be organic such as gut skin or animal skin similar to that which is commonly used on flutes, saxophones and clarinet pads. Any film that will retain an underlying cushion and present a reasonably flat surface for engaging with a tonehole is a suitable substrate to which a hardening foil or powder is applied.

One form of the present invention incorporates a thin layer of gold 3 that is bonded to a pad sealing surface substrate 4. Gold is widely recognized as a superior material to use for the headjoints and bodies of flutes because of its excellent tone producing properties. Tests have shown that plating the pad sealing surface with gold has a dramatic and positive effect on the tone of flutes. The tone difference is easily recognized as an improvement over that of conventional flute pads that are only covered with gut skin. The pad sealing surface 3 is exposed to the inner bore of a flute and the air column that it contains. The vibrating air column is in contact with the pad sealing surface. This contact affects the tone of the flute. The pad sealing surface 3 also comes into contact with a tonehole rim 2 when the pad is closed. Since the flute tube and tonehole rims are all vibrating together, it is easy to understand that anything touching the rim and/or the air column would have an effect on the tone. All of these factors come together to produce an improved tone when gold or other metal is applied to the pad sealing surface because the gold on the sealing surface has a reflective effect that is more beneficial than gut skin or other film without the gold (or other metal) surface.

Blind tests were made to prove that pads with soft, unhardened skin were sound absorbing and detrimental to the tone of flutes when compared to pads with skin that was hardened or metalized. To make these tests, a length of flute tubing was fitted with a row of toneholes and attachment points to accept alternate racks of spring loaded self-centering cups that contained various sets of pads. The racks could be interchanged on the toneholes in a matter of seconds. A head joint was fitted to the length of tubing so that the fundamental note as well as the harmonics (caused by over-blowing) could be played. Pads with hardened or metalized skin were compared to conventional pads with non-hardened or non-metalized skin. The tone improvement of the hardened or metalized pads was obvious. For example, a tone comparison was made between two sets of pads that were identical in every respect except that one set had gold plating on the pad skin. The pads with the gold plating sounded better every time. Similar results were found when using metals other than gold.

It should be noted that speakers used in amplification are being produced with a hard layer on the surface of the speaker cone for the purpose of improving the sound. Such speakers may have a hard material such as carbon fiber, hard plastic, aluminum, titanium or other material applied to the surface of the speaker cone. One example is guitar amplifiers that have a metalized surface on the speaker cones. Another example is headphones—many headphone manufactures advertise that their diaphragms are impregnated or coated with titanium for the purpose of improving the tone quality of the music being listened to.

Another advantage of gold or other metal plating on the sealing surface of pads is that the plating eliminates the problem of sticking as mentioned above. Other hard materials on the sealing surface film 3 show a reduction in sticking but metals such as Gold and Palladium that resist tarnish show the least tendency to stick.

Musicians are very concerned about the visual appearance of their instruments. This is why metal wind instruments are so highly polished. A non-tarnishing gold plated pad is much more beautiful than a pad that is simply covered with gut skin. The visual attraction of gold plated pads makes them very appealing to musicians and helps to insure commercial success. Never before have gold plated pads been available. The beauty of gold is well recognized and musicians will want to beautify their instruments by installing pads that are plated with gold, platinum or other precious and non-precious metals. By comparison, pads without the gold plating have a bland appearance.

It is very important that the pad sealing surface 3 is flat in its planar aspect and that it is without wrinkles. The flatter the surface the better it will prevent unwanted air leakage when the pad is closed and in contact with the tonehole 2 of the wind instrument. One embodiment of the present invention features an inner collar 12. The sealing surface film 3 is stretched across the inner collar so that it becomes smooth and flat. The sealing surface film is then fastened, adhered or held tightly to the inner collar 12 by an outer retaining ring 11. The combination of an inner collar together with an outer retaining ring is a novel design and it provides significant new advantages. David Straubinger (U.S. Pat. No. 6,028,256) is a manufacturer of flute pads who uses an outermost collar and wraps the skin over the collar and around to the back of the pad where it is gathered and glued. This is a laborious process and there is the problem of the back of the pad becoming uneven because the skin is folded and wrinkled at the back of the pad where it is glued to a piece of paper. The glue, paper and gathered folds of the sealing surface all add up in creating an irregular surface at the back of the pad. This makes for variations in the overall thickness of the pad and makes it difficult to adjust the elevation and planer orientation of the pad in the cup so that the sealing surface matches the plane of the tonehole to prevent unwanted leaks. The present invention eliminates this problem because the sealing surface film does not have to extend to the back of the pad and it does not have to be glued. It is only necessary to clamp the sealing surface film 3 to the outside of the inner collar 12 with the outer retaining ring 11. This makes it much easier to assemble a pad because one only has to install the outer retaining rim. Time is saved because no gluing is necessary. The glue does not have to dry and the pad can be immediately installed into a cup 1. It is only necessary for the sealing surface film to wrap around to the periphery of the inner collar 12 enough so that it is held in place by the outer retaining ring 11. Material is saved and gathering is minimized which in turn reduces cost and labor. The outer retaining ring can be used to stretch the skin across the inner collar during the assembly process, thus speeding assembly of the pad. There are alternate ways to fasten the sealing surface film to the outside of the inner collar. A ring of shrink-wrap material 11 can be set in position and then shrunk so that it firmly holds the sealing surface film 3 in place; or adhesive tape 11 can be substituted for the outer retaining ring.

David Straubinger, as mentioned above, uses a delicate and fragile membrane called "bladderskin" for the pad sealing surface. This bladderskin is wrapped across an outermost collar and turns a corner when it is wrapped around to the back of the pad where it is glued. A high degree of stress is placed on the bladderskin when it bends and stretches around the outside corner. This causes premature failure of the skin The outside comer of the Straubinger pad skin is exposed and damage can occur to the delicate bladderskin when the musical wind instrument is cleaned with a polish cloth. The labor involved in installing pads is very expensive and musicians often complain of the frequent failures of Straubinger pads. It is commonly known in the flute industry that Straubinger pads are the most failure prone of all pads. The solution to this problem is to replace the delicate bladderskin with another material that is more durable and does not fail. Various films are available that resist failure. Films with polymeric structures as mentioned above fall into this durable category. Unfortunately it is very difficult to glue these new films adequately as is done with conventional pads using older style bladderskin. Furthermore, it is very difficult to gather and wrap films with polymeric structures around to the back of a pad without creating unwanted wrinkles. Using an outer retaining ring solves this problem because the skin does not have to be gathered and glued. The outer retaining ring makes it possible to assemble pads that incorporate durable new synthetic films previously unused by Straubinger and others. The use of these new and improved films was impractical when using previous/conventional assembly techniques. Although bladderskin can still be used with the present invention, the present invention combines an inner collar, an outer retaining ring and durable new films to create a new pad that has a flat smooth surface and does not fail. Metals such as gold or other non-metallic materials can be added to these new durable films as well.

Another embodiment of the invention is a pad that uses an outer retaining ring, tape or shrink-wrap tubing 11 to secure the sealing surface 3 to the pad 7.

The pads of musical wind instruments have a tendency to get dirty and stick to the toneholes. Moisture and contaminates from human breath build up on the pad's surface in the form of a gooey substance that causes temporary sticking or slow release. The pads can be cleaned to eliminate the sticking. However, even clean pads can stick due to humidity or other factors. The present invention offers a dry lubricant 9 that is applied to the sealing surface 3 in order to eliminate this stickiness. The form of lubricant found to be best suited is of the dry variety such as graphite or molybdenum disulfide. Other forms of dry lubricants may be used such as powdered Teflon or any finely granulated powder that prevents the sealing surface from sticking to the tonehole. The dry lubricant can be applied to the pad and or tonehole rim in any convenient manner. One method is to place the dry lubricant in a small container/dispenser so that it can be easily handled. The dispenser may have a small hole in one end. The hole may be covered with a fine screen to restrict and control the egress of the dry lubricant. The pad of a musical instrument is positioned so that it is open and exposed—preferably with the sealing surface facing upwards. The dry lubricant is then sprinkled onto the pad-sealing surface by aiming the dispenser at the sealing surface and tapping on the dispenser to transfer some of the dry lubricant from the dispenser to the pad-sealing surface. The pad can then be closed onto the tonehole rim so that dry lubricant becomes temporarily trapped between the pad sealing surface and the tonehole rim. When the pad in operated under normal playing conditions, some of the dry lubricant remains attached to the pad sealing-surface and/or tonehole rim—thus preventing unwanted sticking (or slow release) of the pad to/from the tonehole rim.

Many different types of skins and films were experimented with during the development of the present invention. Some of them exhibited a tendency to stick to the tonehole even though the surface was clean. Molybdenum disulfide was found to be particularly successful in preventing stickiness of the pad. In some cases the dry lubricant 9 was impregnated into the sealing surface 3 of the pad. The dry lubricant is comprised of miniscule platelets that slide over each other on a microscopic level—thus creating a slippery effect. When these platelets are imbedded in the sealing surface 3 they are released over time to prevent sticking of the pad. When they are applied to the surface of a pad sealing surface film 3, they remain in place for an extended time and may need occasional replenishment in order to prevent stickiness. The dry lubricant 9 can also be applied to the surface of a film 3 and work its way into the film structure on a molecular level. In the case of a pad that has developed unwanted stickiness, the dry film can be applied to the offending pad to cure the problem. Any sticky areas of the pad or tonehole rim will cling to the dry lubricant. The sticky areas will now be coated with dry lubricant and the slow release of the pad from the tonehole 2 will be eliminated. The dry lubricant can be applied to the pads during manufacture or it can be sold to musicians or repairman in a dispenser to be applied to the pads when necessary. In the case of the flute, the flute is held upside down while dry lubricant is sprinkled onto the open pad/cup. The cup/pad is then closed while the excess dry lubricant is removed by a puff of breath or a wipe of a cloth. Some dry lubricant will remain trapped between the tonehole rim and the pad sealing surface where it is most needed. The dry lubricant will then prevent the pad from sticking to the tonehole rim when it is closed and re-opened.

FIG. 2 shows an embodiment of the invention where a backing plate is used to support the cushion. The sealing surface 3 and substrate 4 wrap around to the backside of the backing plate 7 and are bonded to the backing plate with an adhesive.

FIG. 3 is another embodiment of the invention with a backing plate 7 and an outer retaining lip 8. The outer retaining lip is used to secure the sealing surface in place against the cushion 5. A film 6 is used to stiffen the cushion so that the outer retaining lip 8 will more effectively hold the cushion 5 and sealing surface 3 within the pad holder 10.

Figure 4:
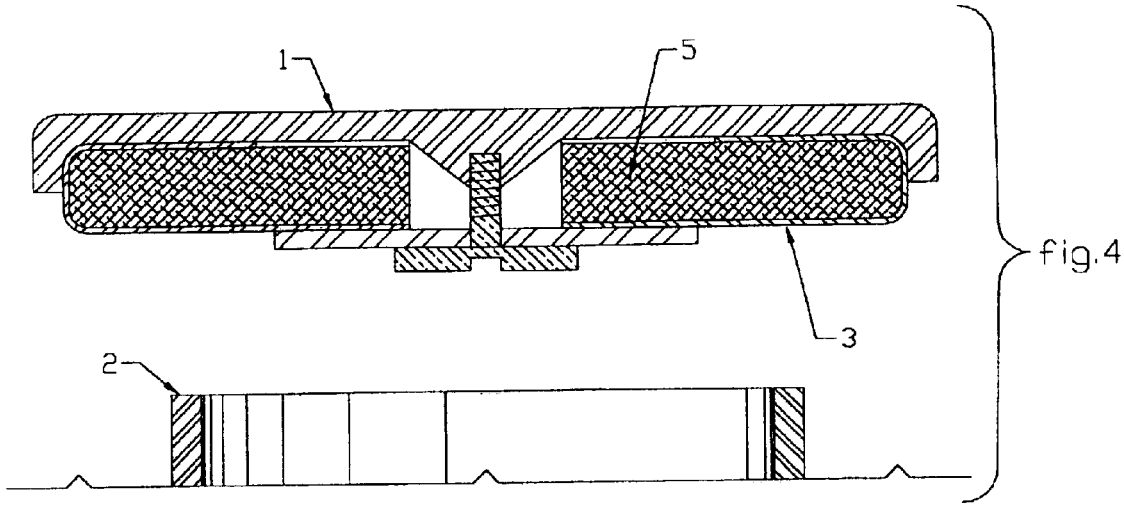
FIG. 4 shows a sealing surface that is impregnated with metal or other hard material.

FIG. 4 shows a pad with a single or continuous sealing surface.

Figure 5A:
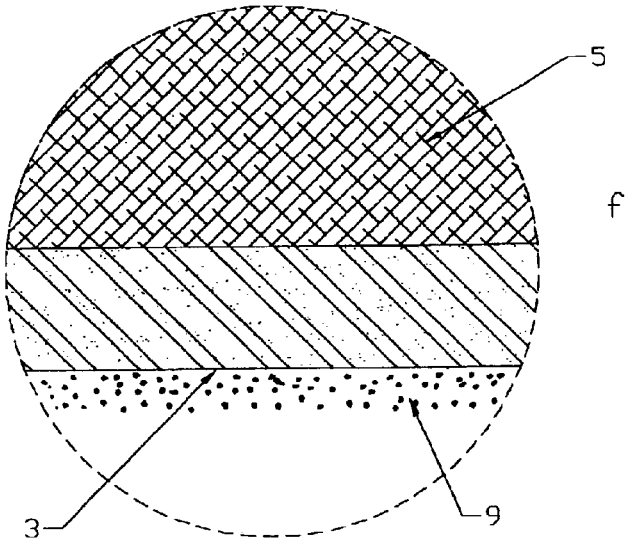
FIG. 5*a* shows an exploded view of a section of FIG. 5.
Figure 5:
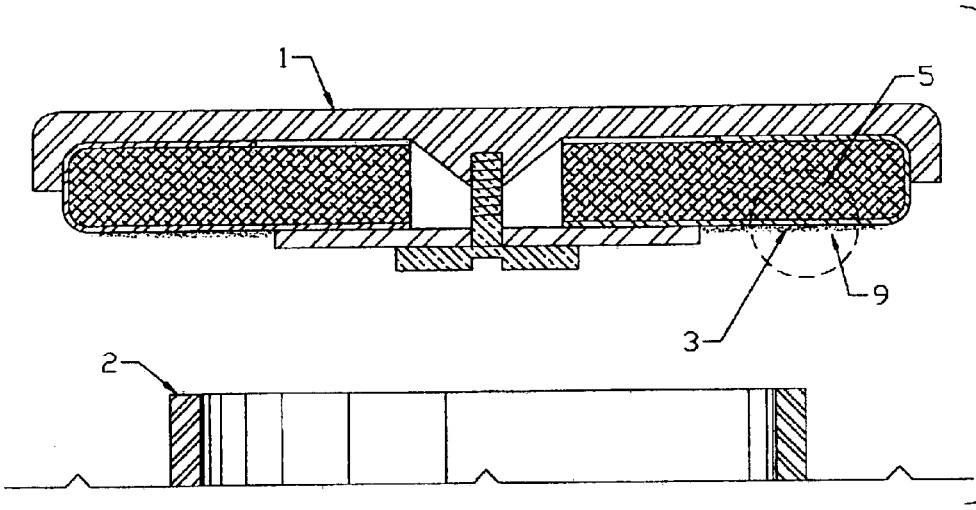
FIG. 5 is similar to FIG. 4 but shows a dry lubricant on a sealing surface.

FIG. 5 shows a pad with a single or continuous sealing surface. Such a sealing surface may have a hard material such as powdered metal impregnated onto the sealing surface. Other materials such as powdered ceramic, powdered crystals, hard plastic granules, carbon fiber filaments, glass filaments such as fiberglass, natural fibers or any hardening material may be applied on the sealing surface film.

Figure 6A:
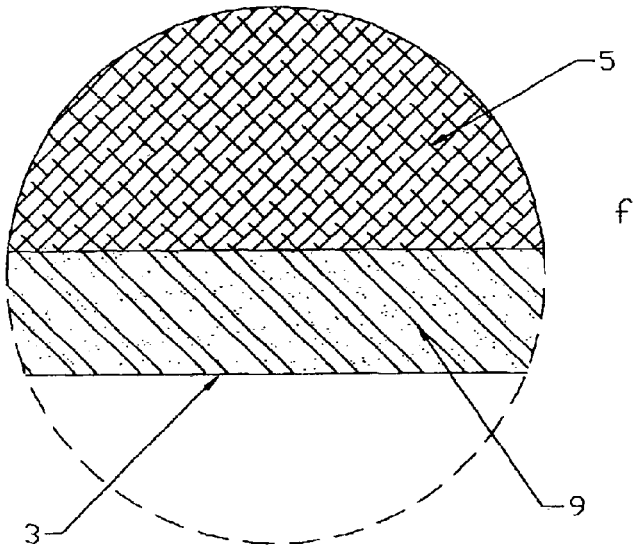
FIG. 6*a* shows an exploded view of a section of FIG. 6.
Figure 6:
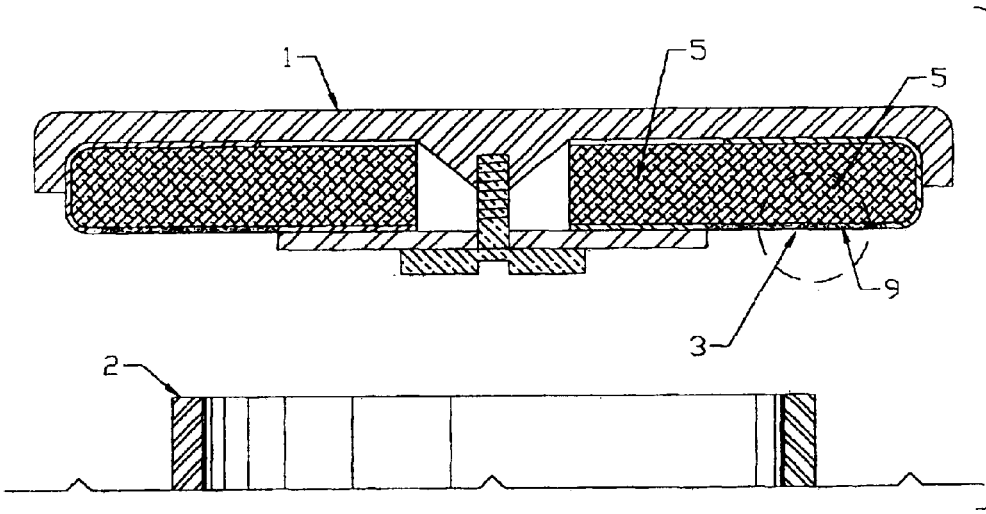
FIG. 6 is similar to FIG. 5 but shows a dry lubricant impregnated into a sealing surface.

FIG. 6 shows a pad with a single or continuous sealing surface 3. Such a sealing surface may have a hard material such as powdered metal impregnated into and/or throughout the sealing surface. Other materials such as powdered ceramic, powdered crystals, hard plastic granules, carbon fiber filaments, glass filaments such as fiberglass, natural fibers or any hardening material may be impregnated into the sealing surface film.

Figure 7A:
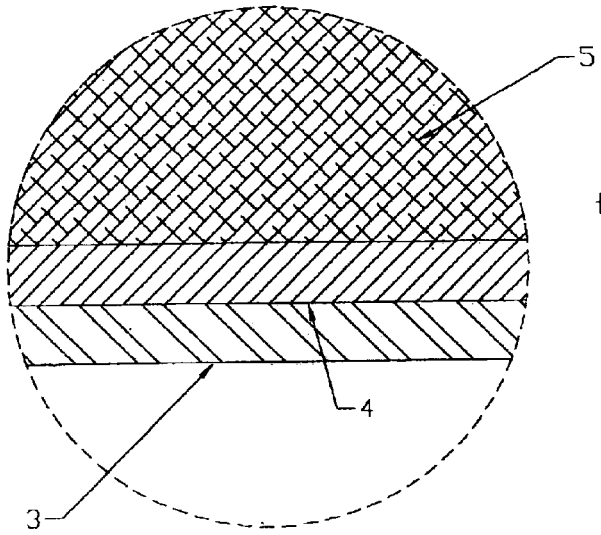
FIG. 7 and FIG. 7*a* show a normal view and an exploded view of a gold layer that has been bonded to an underlying layer of flexible film.
Figure 7:
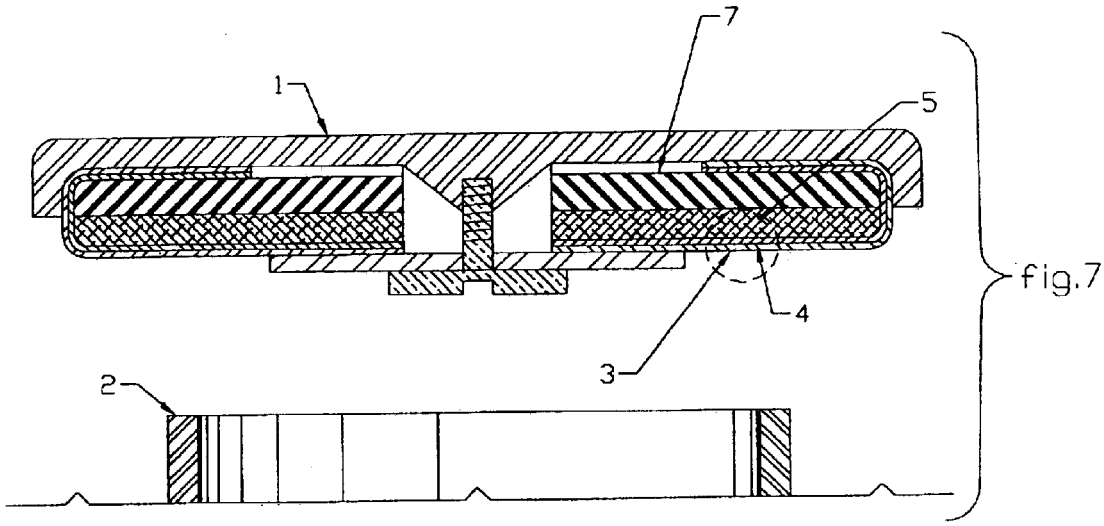
Figure 8A:
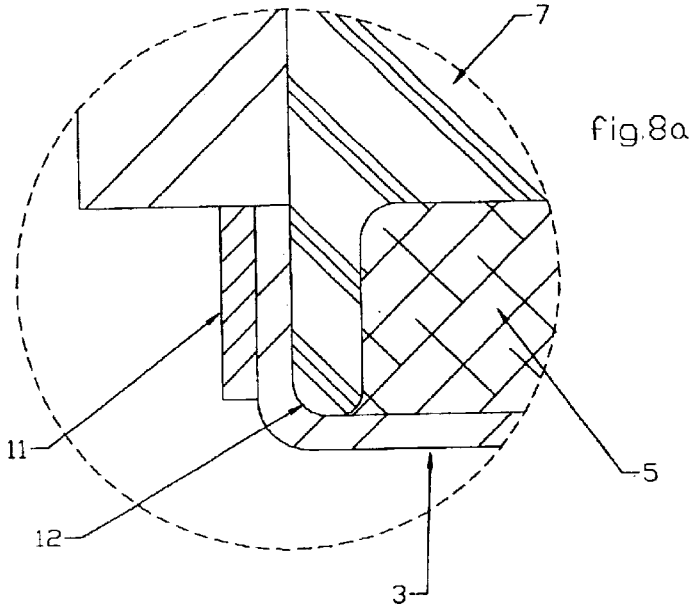
FIG. 8 and FIG. 8*a* show a normal view and an exploded view of a pad with an inner collar to help flatten a sealing surface and an outer retaining ring to fasten the sealing surface to a pad holder.
Figure 8:
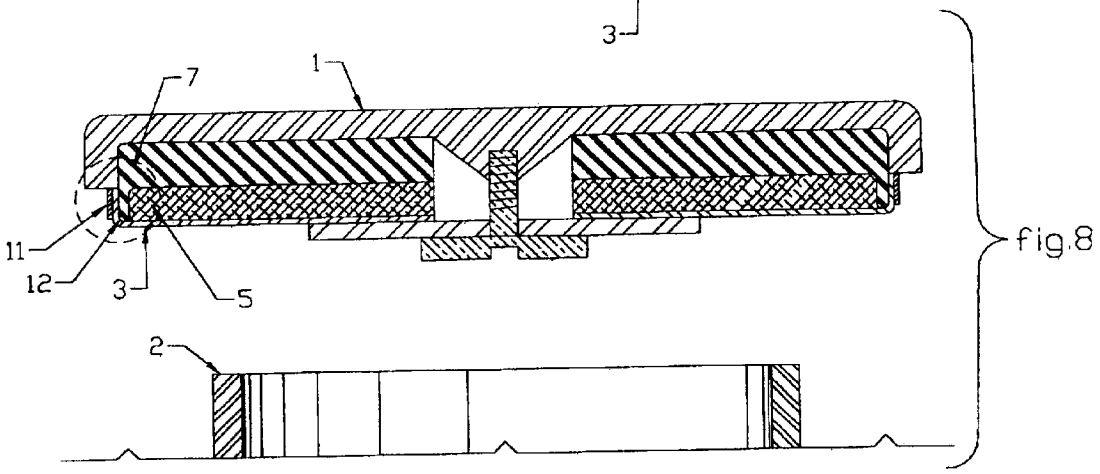
Figure 9A:
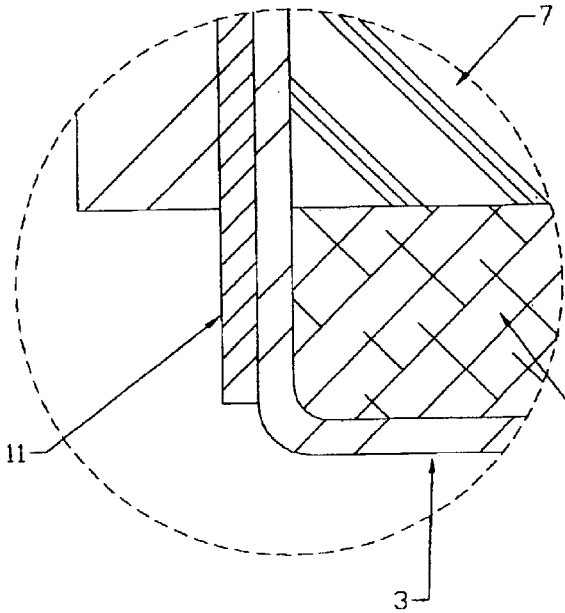
FIG. 9 and FIG. 9*a* show a normal view and an exploded view of a pad with an outer retaining ring to fasten a sealing surface to a pad holder.
Figure 9:
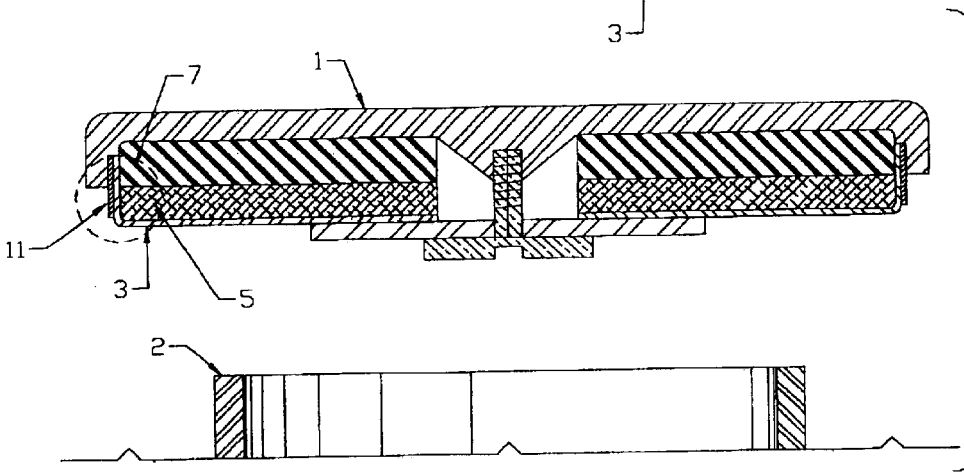

FIG. 7 shows a pad with a sealing surface substrate 4 that has been coated, layered or impregnated with a hard material such as metal 3. Other materials such as powdered ceramic, powdered crystals, hard plastic granules, carbon fiber filaments, glass filaments such as fiberglass, natural fibers or any hardening material 3 may be applied to the sealing surface film substrate 4.

DRAWING REFERENCE NUMERALS

1 cup
2 tonehole
3 sealing surface
4 film substrate
5 cushion
6 backing
7 backing plate
8 dovetail
9 dry lubricant
10 pad holder
11 outer retaining ring
12 inner collar

I claim:

1. A pad assembly, receivable within a cup, for removable engagement with the tonehole rim of a musical instrument comprising:

a rigid disc for insertion into said cup, said disc having a first surface adjacent to said cup, an opposite second surface adjacent to a cushion, and a circumferential edge between said first and second surfaces;

a film layer in contact with said cushion for sealing engagement with said tonehole rim;

said disc having an outer peripheral collar for insertion into said cup;

said outer peripheral collar being juxtaposed laterally to the outside of said edge and said film.

2. The assembly of claim 1 wherein said outer peripheral collar is a clamping means for securing said film between said edge and said outer peripheral collar.

3. A pad assembly, receivable within a cup, for removable engagement with the tonehole rim of a musical instrument comprising:

a rigid disc for insertion into said cup, said disc having a back surface adjacent to said cup, an opposite front surface adjacent to a cushion, and a circumferential edge between said front and back surfaces;

a film layer in contact with said cushion for sealing engagement with said tonehole rim;

said disc having first and second coaxial collars for insertion into said cup;

said first collar being an outer peripheral collar and said second collar being an inner collar;

said outer peripheral collar being juxtaposed laterally to the outside of said edge and said film.

4. The assembly of claim 3 wherein said outer peripheral collar is a clamping means for securing said film between said edge and said outer peripheral collar.

5. A pad assembly, receivable within a cup, for removable engagement with the tonehole rim of a valved musical wind instrument comprising:

a compliant disc shaped cushion disposed in said cup;

a film layer adjacent to said cushion for engaging said rim;

said film baying a coating to prevent it from temporarily adhering to said rim;

said coating being metallic.

6. The assembly of claim 5 wherein the metallic coating is comprised of gold.

7. The assembly of claim 5 wherein the metallic coating is comprised of palladium.

8. A pad assembly, receivable within a cup, for removable engagement with the tonehole rim of a musical instrument comprising:

a compliant disc shaped cushion disposed in said cup;

a film layer adjacent to said cushion for engaging said tonehole;

said film having a crystalline coating.

9. A pad assembly, receivable within a cup, for removable engagement with the tonehole rim of a musical instrument comprising:

a compliant disc shaped cushion disposed in said cup;

a film layer adjacent to said cushion for engaging said tonehole;

said film having a coating of carbon fibers.

10. A pad assembly, receivable within a cup, for removable engagement with the tonehole rim of a musical instrument comprising:

a compliant disc shaped cushion disposed in said cup;

a film layer adjacent to said cushion for engaging said tonehole;

said film having a coating of dry lubricant.

11. A pad assembly, receivable within a cup, for removable engagement with the tonehole rim of a musical instrument comprising:

a compliant disc shaped cushion disposed in said cup;

a film layer adjacent to said cushion for engaging said tonehole;

said film being impregnated with crystals.

12. A pad assembly, receivable within a cup, for removable engagement with the tonehole rim of a musical instrument comprising:

a compliant disc shaped cushion disposed in said cup;

a film layer adjacent to said cushion for engaging said tonehole;

said film being impregnated with ceramic particles.

13. A pad assembly, receivable within a cup, for removable engagement with the tonehole rim of a musical instrument comprising:

a compliant disc shaped cushion disposed in said cup;

a film layer adjacent to said cushion for engaging said tonehole;

said film being impregnated with carbon fibers.

14. A pad assembly, receivable within a cup, for removable engagement with the tonehole rim of a musical instrument comprising:

a compliant disc shaped cushion disposed in said cup, a film layer adjacent to said cushion for engaging said tonehole;

said film being impregnated with a dry lubricant.

15. A pad assembly, receivable within a cup, for removable engagement with the tonehole rim of a musical instrument comprising a compliant disc shaped cushion disposed in said cup, said disc having a front surface for engaging said tonehole rim and a back surface removably disposed in said cup, said front surface having a coating of glass fibers.

16. A pad assembly, receivable within a cup, for removable engagement with the tonehole rim of a musical instrument comprising:

a compliant disc shaped cushion disposed in said cup;

a film layer adjacent to said cushion for engaging said tonehole;

said film being impregnated with metallic particles.

17. The assembly of claim 16 wherein said film has a metallic coating.

* * * * *

UNITED STATES PATENT AND TRADEMARK OFFICE

CERTIFICATE OF CORRECTION

PATENT NO. : 6,940,007 B2
APPLICATION NO. : 10/353588
DATED : September 6, 2005
INVENTOR(S) : James Schmidt It is certified that error appears in the above-identified patent and that said Letters Patent is hereby corrected as shown below:

Column 7, Claim 5 should read:

5. A pad assembly, receivable within a cup, for removable engagement with the tonehole rim of a valved musical wind instrument comprising:

a compliant disc shaped cushion disposed in said cup;

a film layer adjacent to said cushion for engaging said rim;

said film having a coating to prevent it from temporarily adhering to said rim;

said coating being metallic.

Signed and Sealed this

Twenty-ninth Day of January, 2008

JON W. DUDAS
*Director of the United States Patent and Trademark Office*